United States Patent [19]

Williams

[11] Patent Number: 4,489,994

[45] Date of Patent: Dec. 25, 1984

[54] PUNCH AND DIE STORAGE BOXES

[76] Inventor: Barry E. Williams, 8200 Boulevard East, North Bergen, N.J. 07047

[21] Appl. No.: 475,153

[22] Filed: Mar. 14, 1983

[51] Int. Cl.[3] ..... A47F 3/14

[52] U.S. Cl. ..... 312/119; 211/60 R; 211/69; 217/62; 292/63; 292/300; 292/DIG. 46; 312/126; 312/131; 312/291; 312/350

[58] Field of Search ..... 312/131, 117, 126, 128, 312/129, 291, 130, 132, 292, 350, 324, 119, 351, 286; 211/60 R, 60 A, 69; 217/21, 19, 62, 58; 206/379, 373; 292/DIG. 46, 300, 63

[56] References Cited

U.S. PATENT DOCUMENTS

| | | | |
|---|---|---|---|
| 107,753 | 9/1870 | Belding | 312/126 X |
| 117,107 | 7/1871 | Phillips | 312/119 |
| 641,614 | 1/1900 | Stebbins | 312/286 X |
| 697,532 | 4/1902 | Peal | 312/119 |
| 948,521 | 2/1910 | Payne | 312/117 |
| 1,406,758 | 2/1922 | Purdie | 312/324 X |
| 1,505,355 | 8/1924 | Larsen | 206/373 |
| 1,966,734 | 7/1934 | Rosen | 211/60 A |
| 3,189,390 | 6/1965 | Elliott | 217/62 |
| 3,648,836 | 3/1972 | Castner | 211/60 R X |
| 4,253,830 | 3/1981 | Kazen et al. | 206/379 X |

FOREIGN PATENT DOCUMENTS

| | | | |
|---|---|---|---|
| 513267 | 10/1952 | Belgium | 217/19 |
| 1028232 | 11/1950 | France | 217/62 |
| 354904 | 8/1931 | United Kingdom | 312/351 |
| 460514 | 1/1937 | United Kingdom | 312/351 |

*Primary Examiner*—William E. Lyddane
*Assistant Examiner*—Thomas A. Rendos
*Attorney, Agent, or Firm*—Kirschstein, Kirschstein, Ottinger & Israel

[57] ABSTRACT

Storage cabinets for storing single sets of punches and dies when not being used in tabletting machines. The tabletting machine customarily employs a single such set of punches and dies. A storage cabinet includes plural horizontal trays providing plural horizontal nests for horizontally storing punches. It also includes plural horizontal drawers for storing dies that match the stored punches. The cabinet also may include a lesser number of door-carried vertically oriented punch nests for storing vertically oriented punches. All of the stored punches are so situated that their operative surfaces are protected against striking metal objects so that they will not be nicked, scratched or dented, necessitating repair. The cabinets are of a proper size for modular storage on a toolmaker's steel shelving.

8 Claims, 17 Drawing Figures

22
92
96
100
102
106
108
110
112
114
46
48
54
R'
L'
94
128
130
132
134
136
138
140
142
144
146
148
150
156
98
16

PUNCH AND DIE STORAGE BOXES

BACKGROUND OF THE INVENTION

1. Field of the Invention

Containers for storing sets of interchangeable punches and dies for circular tabletting machines.

2. Description of the Prior Art

To better understand the nature of the present invention, a short description of the machine with which the containers of said invention is used is in order.

It is known in the art as a tabletting machine. It is circular and has many stations. Typically it may have as few as 18 stations and as many as 70. The machines are made by various manufacturers. They customarily include a circular table with a series of dies around the same near its periphery at regularly spaced intervals. There is a plate above the table and a plate below the table. The two plates have vertical through openings into which punches are adapted to be fitted for cooperation with the dies, there being an upper punch and a lower punch for each die. Customarily, there is a die for each station. Thus, if there are, for example, 48 stations, there will be 48 dies and 96 punches.

The table and the upper and lower plates rotate intermittently and in unison from station to station, stopping at each station where an operation may or may not be performed. Typical operations include feeding of a pharmaceutical powder, compacting of the powder into a tablet, ejection of the tablet, and cleaning of the punches and dies.

Many positions of the punches are intermediate positions, that is to say, positions at which the punches are intermediate an idle position and a fully operative position; or, phrased differently, they are either in an idle position or in a position in which they are moving toward a fully operative position. The punches customarily are caused to move by suitable cams that engage followers on the punches.

A complete set of dies for one size of tablet will be characterized by a uniform diameter of bore. However, all the tablets made with that die may not be the same. Some tablets may be heavier than others, depending upon the amount of powder fed into the die and the amount of compression exercised by the punches, i.e. the ultimate spacing between the punches. A machine may accept dies whose outer diameters are the same but whose bore diameters are different. Thus, there can be more than one set of dies which differ from one another by differing bore diameters. Different bore diameters will be used to make different sizes of tablets.

Similarly, the punches will be shaped to match different sizes of bore diameters. Thus, there will be one set of upper and lower punches sized to fit one bore diameter of dies, and another set of upper and lower punches sized to fit another set of bore diameters of dies, and there may be more than one set of upper and lower punches for a given bore diameter of dies if, for a given bore diameter, it is desired to make tablets of different weights (different heights).

All of these different sets of punches and dies can be used interchangeably in the same tabletting machine. More particularly, any given set of dies can be used in a given tabletting machine with a given set of upper and lower punches for the manufacture of a certain shape and weight of tablet. If it is desired to manufacture a different size and weight of tablet, a different set of dies and a different set of upper and lower punches will replace the set of dies and the set of upper and lower punches in the machine.

It thus will be apparent that any given tabletting machine will employ several sets of dies and correspondingly several sets of upper and lower punches. Only one set of dies and one set of upper and lower punches will be used on the tabletting machine at a time. The remaining sets of dies and the remaining sets of upper and lower punches must be stored, awaiting their turn for use. This has been the trade practice for many years.

There are, however, many problems associated with this trade practice. If the punches are so stored that their operative edges can touch metal, either during handling or while they are in storage, the operative surfaces can be nicked, scratched or dented, whereupon they must be re-ground in order to make perfect tablets. The same is true of the dies. Also, there is a tendency for the storage containers to occupy too great a space and, if one takes into account the large number of sets of dies and of upper and lower punches, a considerable problem is thus created. Therefore, it is important that the storage container hold the dies and punches in a highly compact arrangement which is particularly conservative as to the space they occupy.

At the present time, the most widely used type of storage box for punches constitutes a honeycomb of vertically elongated cells in which the punches are vertically arranged. With such a configuration, the punches tend to bang against the bottom of the storage box where ultimately they become scratched, nicked or dented and have to be redressed. There is no convenient storage space in these containers to accommodate the dies.

SUMMARY OF THE INVENTION

1. Purposes of the Invention

It is an object of the present invention to provide a storage container for punches and dies of the character described which enables these tools to be stored in a highly compact and safe manner where they will not fall out, where the punches cannot touch one another, where the punches cannot touch the dies, where the punches are prevented from being nicked, scratched or dented, which can be made inexpensively, which will occupy a minimum of space on a tool-and-die maker's storage rack, and which is specially dimensioned to be conveniently fitted within the confines of a tool-and-die maker's shelf.

It is another object of the invention to provide a storage box for punches and dies of the character described which is particularly easy to use and handle, which is simple to slip tools into and simple to withdraw tools from, from and into which tools can be withdrawn and inserted quickly and easily and without danger to the tools.

It is another object of the invention to provide a storage box for punches and dies of the character described which constitutes relatively few parts that can be assembled at a low cost and will serve the purpose for which it is designed with great efficiency.

It is another object of the invention to provide a storage box for punches and dies of the character described which will support the dies and punches uniformly and protect their compressing and follower surfaces.

Other objects of the invention in part will be obvious and in part will be pointed out hereinafter.

2. Brief Description of the Invention

The container of the present invention is adapted to store punches and dies of conventional construction which are adapted to be interchangeably used in the manner aforesaid in a standard tabletting machine. As mentioned above, in a standard tabletting machine there are two plates of substantial diameter which are mounted to intermittently rotate in unison together with a disc that is located between them. The two plates and the disc are formed with matched openings in vertical registration. The openings in the central disc have the dies fixed therein. The openings in the upper and lower plates have the respective upper and lower punches vertically reciprocatably mounted thereon.

The machine has several stations, including a filling station at which the upper punch is clear of the die but the lower punch blocks the opening at the bottom of the die. Thereafter, as the plates and disc intermittently rotate, suitable cams cause the upper punch to move downwardly into the die and compress the powder therein to quite a substantial extent, typically as much as ten tons, thereby to form a tablet which is highly compact and hard, hard enough to be handled by the ultimate user without fear of crumbling. The tablet, of course, includes components which will enable the tablet to be assimilated in the alimentary canal.

After compression, the upper punch is raised and then the lower punch is raised to lift the tablet out of the die and above the upper surface thereof from which it is swept into a suitable handling device. The punches are moved up and down by conventional cams which act upon follower surfaces on the punches.

Because the tabletting machines are so conventional, the machine has not been illustrated and will not be further described in the specification.

The upper and lower punches are essentially identical and, for the purpose of the storage container of the present invention, may be considered identical and, therefore, will not be differentiated in the description thereof or in their illustration.

A typical die has two outer ends of cylindrical configuration and identical diameter joined by a waist. The die is formed with a central through bore, the configuration of which will depend upon the desired shape of the tablet. The tablet which the dies shown subsequently are configured to manufacture are circular. Hence, the through bore in these dies are circular. If the tablets are to have some other configuration, the through bores will have a similar configuration. For example, if the tablets are to have an oval configuration, the bore in the dies will be oval; if the tablets are to have an octagonal configuration, the dies will have bores of octagonal configuration, etc.

The outer cylindrical surfaces of the dies at their ends are ground to a fine finish which is adapted to be received in a squeeze fit in the matching opening in the disc of the tabletting machine; in other words, the dies must be driven into said opening because, when once in, they are intended to remain in position as the dies reciprocate in and out of the same, and to remove the dies, the dies must be forced out of the disc.

The dies are rather squat. Their height matches the thickness of the disc in which they are received.

The punches are elongated and include cylindrical solid barrels which are many times longer than the dies. At one end, the barrel terminates in a neck which carries an enlarged mushroom head that constitutes a cam follower. At the other end of the barrel, another neck is provided. This neck is somewhat longer than the neck on which the mushroom head is secured, and this second neck terminates in a smaller head. The smaller head has a diameter which is slightly less than the diameter of the bore in the associated die. The configuration of the smaller head is such that it matches the configuration of the bore in the die, and the dimensions of the smaller head are such that the smaller head will be received in the bore in the die in a sliding fit.

The invention consists in the features of construction, combination of elements and arrangement of parts which will be exemplified in the device hereinafter described and of which the scope of application will be indicated in the appended claims.

BRIEF DESCRIPTION OF THE DRAWINGS

In the accompanying drawings in which are shown various possible embodiments of the invention.

DETAILED DESCRIPTION OF THE PREFERRED EMBODIMENTS

Figure 1:
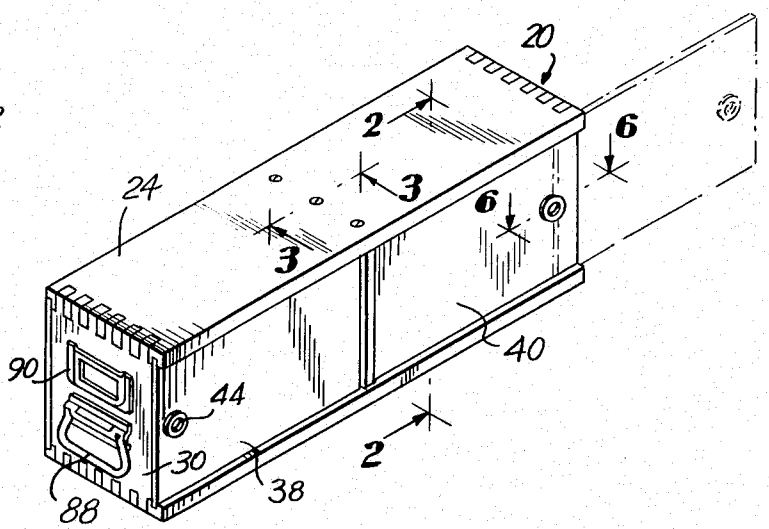
FIG. 1 is a perspective view of a storage cabinet embodying one form of the invention.

Referring now in detail to the drawings, and more particularly to FIGS. 1–7, the reference numeral 20 denotes a storage cabinet containing a certain specific number of dies and double that certain specific number of punches, for a tabletting machine. Generally speaking, the upper and lower punches of a tabletting machine are interchangeable. The number of dies may vary quite widely. The cabinet 20 is designed to accommodate a number of dies and punches which will fit tabletting machines adapted to employ different numbers of punches and dies, for example, from 40 to 80 dies and from 80 to 160 punches. This, of course, is insufficient for all tabletting machines on the market, and it is for this reason that there are provided, as illustrated herein, more than one style of storage cabinet.

In FIGS. 8–17 a storage cabinet 22 is illustrated which is designed to hold a greater number of punches and dies, for example, from 70 to 140 dies and from 140 to 280 punches. The storage cabinet selected by the tabletter will depend upon the storage capacity provided by the storage cabinets. It will be realized that different cabinets may be differently sized to accommodate different numbers of punches and dies, and that the particular capacity of any given cabinet will be selected to match the number of punches and dies for a particular machine. Thus, if a tabletting machine is designed to receive, by way of example, 60 dies and 120 punches, then a cabinet for this machine will be designed to accommodate that number of punches and dies, and there may be several such cabinets, each adapted to receive dies and punches of different sizes and different tablet shapes.

It thus will be seen that for any given tabletting machine there may be several storage cabinets, only one at a time of which will have punches and dies withdrawn therefrom for use in the machine, while the rest of the dies and punches in the remaining cabinets stand by idly awaiting their turn for use.

In the descriptions about to be given of the two different cabinets 20 and 22, the particular numbers of punches and dies is not of any consequence because the cabinets usually are custom made to conform to the demands for any particular tabletting machine or machines. Accordingly, any numbers of punches and dies that may be computed from inspection of the drawings or from following the descriptions of these cabinets are not to be considered as limiting.

Referring now to FIGS. 1–7, the cabinet 20 is made of clear aspen, except as otherwise noted, as a convenient material which is lightweight and dimensionally stable. By way of example, this cabinet is 23½" long, 7¾" high and 6⅛" deep. It has been found that this is a particularly convenient size, both for receiving punches and dies to store the same, and for placing the storage cabinets on steel storage shelves of standard modular sizes; in other words, cabinets of the aforesaid size fit in a convenient modular manner on modular steel shelving.

Figure 2:
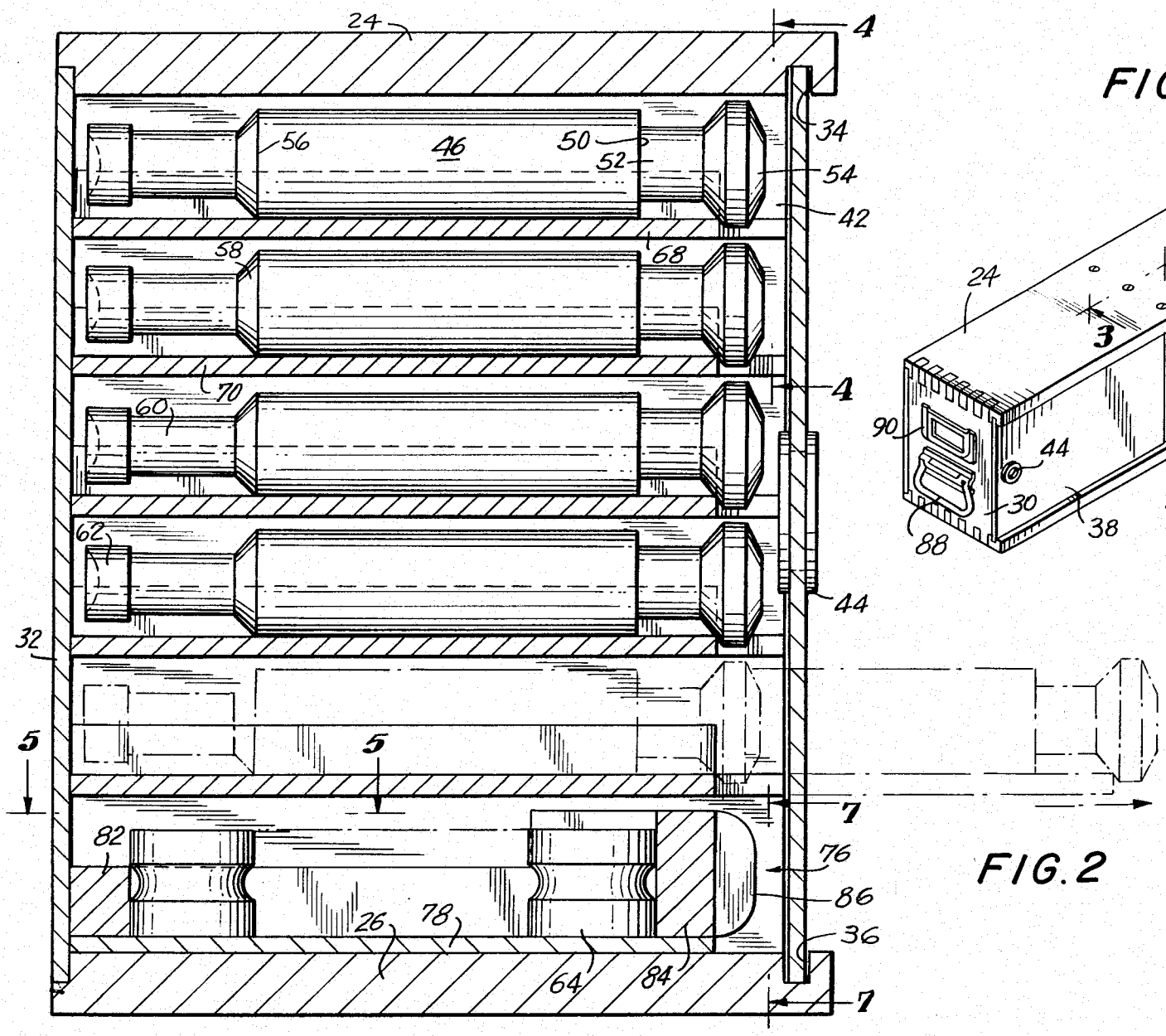
FIG. 2 is an enlarged sectional view taken substantially along the line 2—2 of FIG. 1 and illustrating a staggered vertical section through the cabinet.
Figure 4:
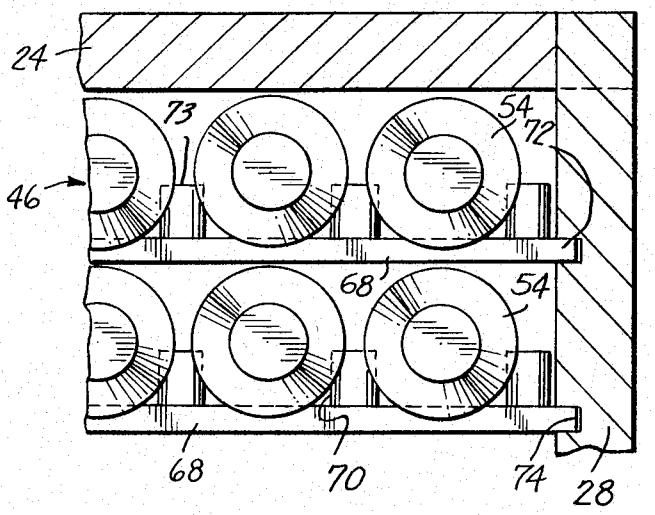
FIG. 4 is an enlarged fragmentary sectional view taken substantially along the line 4—4 of FIG. 2 and illustrating a fragmentary vertical sectional view taken somewhat forward of the section of FIG. 3.

As can be seen from FIGS. 1, 2, 3 and 4, the storage cabinet 20 constitutes a top wall 24, a bottom wall 26, a right-hand wall 28 (FIG. 4), a left-hand wall 30 (FIG. 1), and a rear wall 32 (FIG. 2). The top and bottom walls and the right-hand and left-hand walls are of ½" stock joined at the corners by notched butt joints. The rear wall 32 conveniently is formed of 3/16" tempered hardboard set into rabbetts at the rear edges of the top and bottom walls (FIG. 2). Said rear wall gives strength and rigidity to the cabinet, as do the glued notched butt joints. Indeed, the cabinet so formed is sufficiently rigid to carry the rather substantial weight of a large number of punches and dies without the presence of a fitted front wall. Nevertheless, it is desirable to have a front wall to keep out dust and dirt and, for this purpose, the lower front edges of the top and bottom walls 24, 26 protrude beyond the front edges of the right- and left-hand walls 28, 30 ( FIG. 2) where they are formed with rabbetted grooves 34, 36 for the full length of the cabinet to receive left-hand and right-hand sliding doors of tempered hardboard panels 38, 40 whose inner edges butt up against the outwardly facing side edges of a front-to-back partition 42 (FIGS. 2 and 3) that divides the cabinet into left- and right-hand compartments L and R.

To ease the sliding movement of the doors in the rabbets 34, 36, the upper and lower longitudinal edges of said doors are lightly beveled. The doors are provided with thermoplastic handles 44, each of which comprises a pair of flat spaced discs lying on a different face of the door and interconnected by a short barrel passing through an aperture in the door. One of the discs is initially supplied in the form of a cylindrical extension of the barrel and, after passage through the aperture in the door, is spun out to constitute the other disc with the use of a heated tool. The two discs are respectively above the levels of the outer surfaces of the door, and advantage is taken of this to latch the doors in a position in which they close their respective compartments. For this purpose, the handles are so located that the disc of each handle lies near the inner surface of an adjacent right- or left-hand wall 28 or 30 of a closed door and, by butting up against the same, inhibits outward movement of the door, except if the door is manually bowed outwardly, the door can be slid open because in that position the handle will clear the edge of the respective wall 28 or 30. Both doors are illustrated in closed position in FIG. 1, and the right-hand door is shown in closed position in solid lines in FIG. 6, and in bowed position and partially open in dot-and-dash lines in FIG. 6.

The left and right compartments L and R are mirror images of each other. Each includes suitable supports and trays for nesting therein punches and dies. A typical punch 46 is shown in plan in FIG. 2. The same punch is employed in conjunction with the cabinets of FIGS. 1–7 and FIGS. 8–17. Said punches include a barrel 48 of cylindrical configuration which at its outer end 50 is provided with a short neck 52 terminating in a head 54. The inner end 56 of the barrel runs into a taper 58 that terminates in a long neck 60 at the end of which a tabletting punch head 62 is carried. The operative surface of the punch head 62 is suitably shaped to impart the desired configuration to the matching surface of a tablet. The particular configuration here illustrated is concave, which will impart a convex configuration to the corresponding surface of the tablet. The entire outer surface of the tabletting punch is concave. The geometrical configuration of the punch head 62 conforms to the desired plan geometrical configuration of the tablet to be formed. The tablet to be formed in the tabletting machine by the punch 46 is a circular tablet with convex upper and lower sides. Hence, the plan configuration of the punch is circular. It will be appreciated that if some other configuration is desired for the tablet, the punch 62 will have a corresponding configuration. The barrel 48 is designed to be oscillated in the upper plate (not shown) of the tabletting machine by means of suitable mechanisms such as cams designed, for example, to ride on followers on the punch, e.g. on the head 54, or on the taper 58, or on both.

Figure 5:
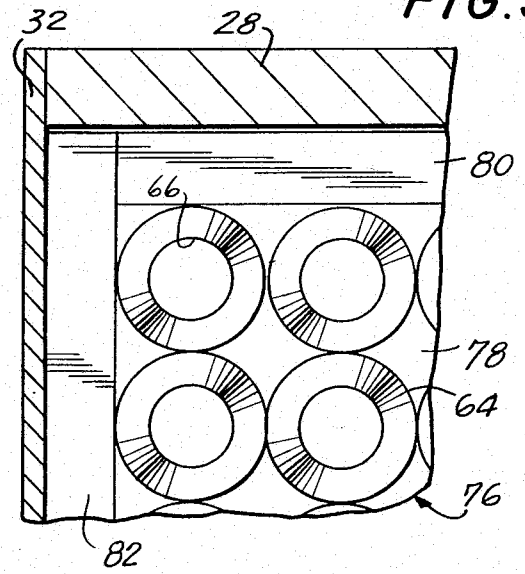
FIG. 5 is an enlarged fragmentary horizontal sectional view taken substantially along the line 5—5 of FIG. 2 and illustrating the interior of the cabinet immediately above the corner of the tray in which dies are stored.
Figure 7:
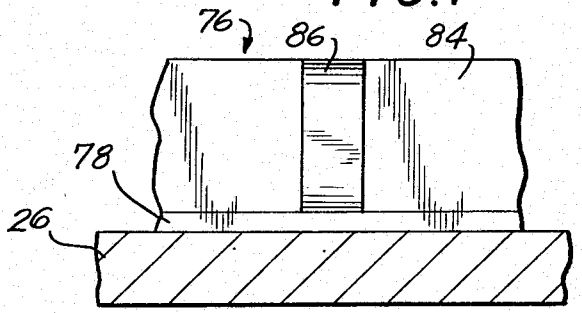
FIG. 7 is an enlarged fragmentary view taken substantially along the line 7—7 of FIG. 2 and illustrating the front of the tray in which the dies are received.
Figure 8:
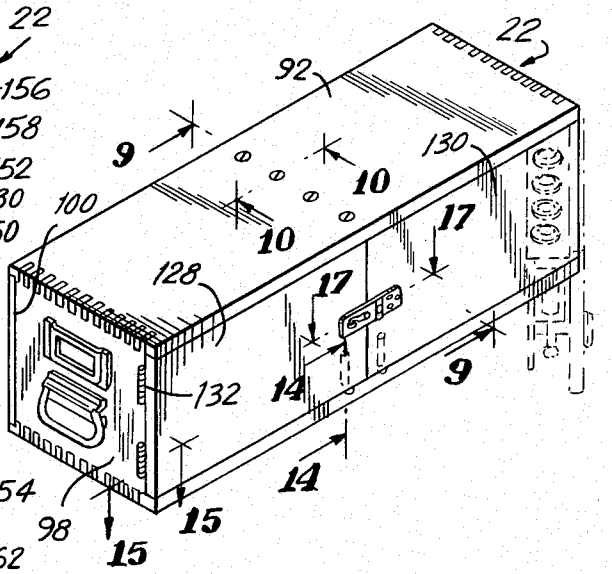
FIG. 8 is a perspective view of a storage cabinet embodying another form of the invention.

The punches are designed to cooperate with dies 64 of which several are illustrated. Each die is circular in plan, as can be seen in FIG. 5, and is designed to engage in a snug fit, usually a drive fit, in a correspondingly shaped opening in the disc of the tabletting machine. Each die, moreover, has a central bore 66 shaped to engage in a sliding fit with the external peripheral shape of the tabletting punch 62.

In a typical tabletting machine, there are a large number of dies. As indicated earlier, the number will vary, depending upon the particular tabletting machine. There may be as few as 40 or as many as, say, 140, and the number of punches will be double the number of dies. When a tabletting machine is set up, the dies are placed in the disc and the punches are placed in the plates, one punch above and one punch below the disc in alignment with the die in the disc. Each punch has its tabletting punch head in register with the bore 66 of the die. As the punches and dies rotate around the machine step by step, the punches move apart sufficiently to expose the bore 66 which, at the time, usually is flush with the upper surface of the disc. Then a pharmaceutical powder is deposited on top of the disc and brushed over the same so as to be deposited in the bore, excess being swept away, whereby a predetermined weight of powder is placed in the bore. Thereafter, the upper punch is lowered into the bore and the lower punch is raised in the bore to exert a substantial compressing force on the powder in the bore, the force being of a substantial degree sufficient to compact the powder in the shape of the tablet as defined by the tips of the punches and the sides of the bore. Next, the upper punch is withdrawn from the bore and the lower punch is raised to lift the nowhard tablet above the upper surface of the disc, and the finished tablet is swept off the disc and packaged.

The constituents of a tablet are conventional and, in passing, it is mentioned that they include the necessary pharmaceutical ingredients, i.e. pharmaceutically active medicaments, e.g. aspirin, an inert carrier if needed as a bulking agent, e.g. talc, a lubricant, e.g. a metallic stearate, and, if necessary, a die-releasing agent, e.g. Quillone, or, in the alternative, the punches and dies may be intermittently sprayed with a die-releasing agent such as a silicone.

The cabinet includes suitable nests for individually holding the required number of punches in relatively secure positions. For this purpose, each compartment is supplied with several horizontal trays 68, the horizontal bottoms of which preferably constitute a single piece of four-ply 3/16" plywood, plywood being preferred because of its dimensional stability and its resistance to warping even under conditions of high humidity such as may prevail in a tabletting area. Each tray is subdivided into a series of side-by-side nests 70 that extend in a front-to-back direction. The side edges of the bottoms of the trays extend beyond the sidemost nests to form front-to-back projections in the form of ribs 72 (FIG. 3) that slide in rabbetted horizontal grooves 74, in the side walls of the partitions 42 and the side walls 28,30 of the cabinet 20. These grooves run all the way from the front to the back of the partitions, thus allowing the trays to be slid forwardly, free of the associated compartment, and also to be slid all the way back into the compartment, the latter position being illustrated in FIG. 2 in solid lines, and a partially pulled out position being illustrated in dot-and-dash lines in the same figure.

Figure 3:
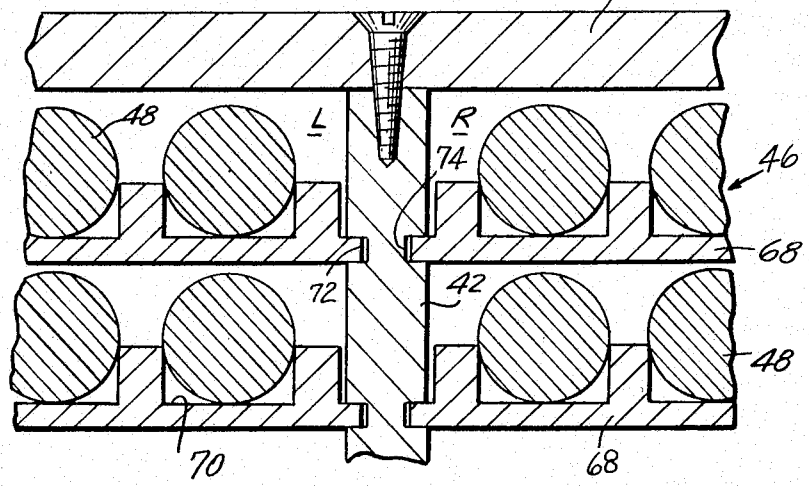
FIG. 3 is an enlarged fragmentary sectional view taken substantially along the line 3—3 of FIG. 1 and illustrating a fragmentary vertical sectional view through a pair of uppermost trays.

The nests 70 are so dimensioned as to fully receive only a single punch 46. More specifically, and as is clearly seen in FIG. 2, when a punch 46 is disposed in a nest, the tapered underside of its mushroom head 54 will butt against the top front corner of the bottom wall of the tray on which it rests, thus defining its inmost position relative to the tray. Furthermore, as can be seen in FIG. 3, the barrel 48 of each punch touches the upper corners of the ribs 73 which define the nest in which the punch is located, thereby precisely locating the lateral position of the punch. Hence, the only freedom of movement that the punch can experience when positioned in the tray is a movement out of the nest and toward the front of the cabinet. Such movement is restricted by the front panel 38 or 40 that closes the compartment in which the punch is situated. The lengths of the nests are such, as clearly is visible in FIG. 2, that the operative tip of the tabletting punch head 62 is spaced a short distance from the front surface of the rear wall 32 of the cabinet.

From all the foregoing, it will be appreciated that each punch is effectively isolated, when situated in its respective nest, from all of the other punches, and no part of the punch can strike a metallic surface whereby to nick, chip, dent or scratch the punch or the operative surface of the tabletting punch head, and the punches thus will be kept in prime condition as long as they are stored in the cabinet 20.

The cabinet 20 illustrated in FIGS. 1–7 has two compartments, L and R, each of which has five trays, each of which has ten nests, or 100 nests in all, so that it will hold 100 punches in storage. If a larger number of punches is required to be held, a larger cabinet, i.e. one which will store a greater number of punches, will be used.

It will be observed that by checking lateral movement of the punches in their nests through abutment of the sides of the barrels against the ribs, and forward movement of the punches by abutment of their heads against the front corners of the trays, no operative parts of the punches are exposed to striking against any surfaces once the punches are stored. Moreover, even the placement of the punches in their trays tends not to expose the punches to striking of their punch heads 62 against metal or even against wood. The movement of the punches into their nests is essentially a longitudinal forward sliding movement of the punches into the nests, and the withdrawal of the punches from their nests again is essentially a longitudinal movement. Neither of these movements involves any extensive transverse shifting of the punches which would expose the heads 62 to striking of metallic surfaces. All of this contrasts with conventional storage cabinets in which punches typically are stored in vertical positions so that the punches are allowed to drop vertically into their nests and, when being introduced into the nests, can expose their punch heads to the possibility of striking the heads 54 of previously nested punches. In FIG. 2 there is shown the direction of withdrawal of a punch from its nest by illustrating the same in dot-and-dash lines and, from this phantom position, it can be seen that a simple translational withdrawal of the punch from its nest is all that is required to remove it from the cabinet.

With respect to the dies 64, storage provision for them likewise is provided. These must be stored carefully, but the same degree of care is not required as with the punches. For storing the dies, a drawer 76, having a bottom 78, sides 80 and a back 82, is supplied at the bottom of each compartment L and R. The front 84 of each drawer is furnished with a handle 86. The back, front and sides of each drawer are so relatively dimensioned as to define a space which will nicely bound an area that will just receive a number of dies equal to one-half the number of punches received by the sundry nests 70 in both compartments L and R; in other words 25 per drawer, a total of 50 dies, which is one die for each two punches—and upper punch and a lower punch. The packing of the dies is illustrated in FIGS. 2 and 5. Since there will be 25 dies in each drawer, they conveniently are placed in front-to-back columns of 5 and side-to-side rows of 5, with just enough loose space so that the dies can be placed in the drawer easily without giving them room for side-to-side or front-to-back movement. Thus, the dies will not bang against one another when the cabinet is shifted about or subjected to shock.

After the punches and dies have been loaded into the cabinet and the panel doors 38, 40 closed, the cabinet can be transported to a place of storage. The cabinet is easily carried by means of bail-type handles 88 provided for that purpose at the ends of the cabinet. An identification frame 90 is located on at least one end of the cabinet to receive a marker that advises interested persons of the contents of the cabinet so that the proper cabinet quickly can be located for any particular set of punches and dies, and so that the proper empty cabinet quickly can be located for reception of punches and dies which are to be stored.

Figure 6:
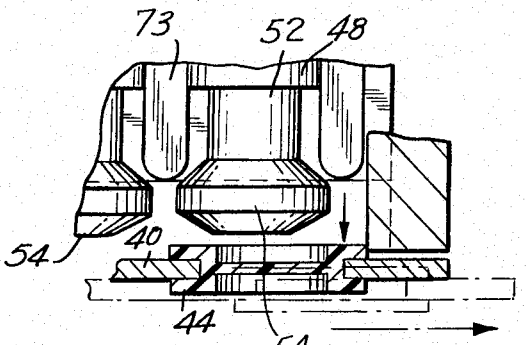
FIG. 6 is an enlarged fragmentary sectional view taken substantially along the line 6—6 of FIG. 1 and illustrating the positions of the heads of the punches in the cabinet.

When the panels 38, 40 are slid to closed position, the ends of the panels are slightly bowed out to permit the inner discs of the handles 44 to clear the front edges of the right- and left-hand walls 28, 30 and be trapped in the fronts of the compartments L, R as shown in FIG. 6. The panel will have to be bowed again when it is desired to slide the panels to open position as shown in dot-and-dash lines in FIGS. 1 and 6.

A cabinet 22 embodying a modified form of the invention is shown in FIGS. 8–17. Said cabinet 22 is basically the same as the cabinet 20, but differs therefrom in that its structure is so arranged as to accommodate a larger number of punches and a larger number of dies, although, for this purpose, the external dimensions of the cabinet have to be somewhat increased. It will be recalled that the external dimensions of the cabinet 20 were $23\frac{1}{2}'' \times 7\frac{3}{4}'' \times 6\frac{1}{8}''$. In contrast, the external dimensions of the cabinet 22 are $23\frac{1}{2}''$ in length, $7\frac{3}{4}''$ in height and $7\frac{3}{4}''$ in depth. The particular size selected for the cabinet 22 is such as to accommodate for storage purposes a total of 120 punches and a total of 60 dies for such punches. The storage for the additional 20 punches is furnished by vertical nests on the compartment doors in combination with horizontal nests on the compartment drawers. It is for this reason that the cabinet 22 is made deeper than the cabinet 20. It will be realized, of course, that cabinets embodying the invention can take on a variety of configurations and structures to accommodate various numbers of punches and dies and that, in general, the cabinets are characterized by the prevalence of horizontal nests on horizontal drawers. The use of vertical nests is a resort that is adopted to conserve space and to attain compactness of structure. But, in general, it is desired to arrange the cabinets so that the majority of the nests are horizontal and on horizontal drawers.

Thus the cabinet 22 includes a top wall 92, a bottom wall 94, a right-hand wall 96, a left-hand wall 98, and a rear wall 100, all constituted of the same materials as those mentioned for the corresponding walls of the cabinet 20. Like the cabinet 20, the cabinet 22 is subdivided into left and right compartments L′ and R′ by a central vertical partition 102 running in a front-to-back direction and approximately the same depth as the partition 42 of the cabinet 20. But since the cabinet 22 is deeper than the cabinet 20, there is a greater space between the front edge of the partition 102 and the front of the cabinet 22 than there is between the front edge of the partition 42 and the front of the cabinet 20. This space, as soon will be seen, is to accommodate vertical racks and nests carried on the inside of doors at the front of the cabinet 22.

Located in the compartments L′ and R′ is a vertical stack of horizontal trays 106, each having a bottom plywood wall 108 from which upstanding ribs 110 protrude, each pair of adjacent ribs defining between them a nest 112 for a different punch. The sides of the trays protrude beyond the sidemost ribs to form runners that are received within horizontal rabbetted grooves 114 in the partition 102. Sufficient room is provided below the bottommost tray to receive a drawer 116 in which dies are received for storage purposes. The drawer has a tempered hardboard bottom 118, a back 120, sides 122 and a front 124, the latter being supplied with a groove 126 which serves as a handle.

Figures 10, 11, 12, 13, 14, 15, 16, 17:
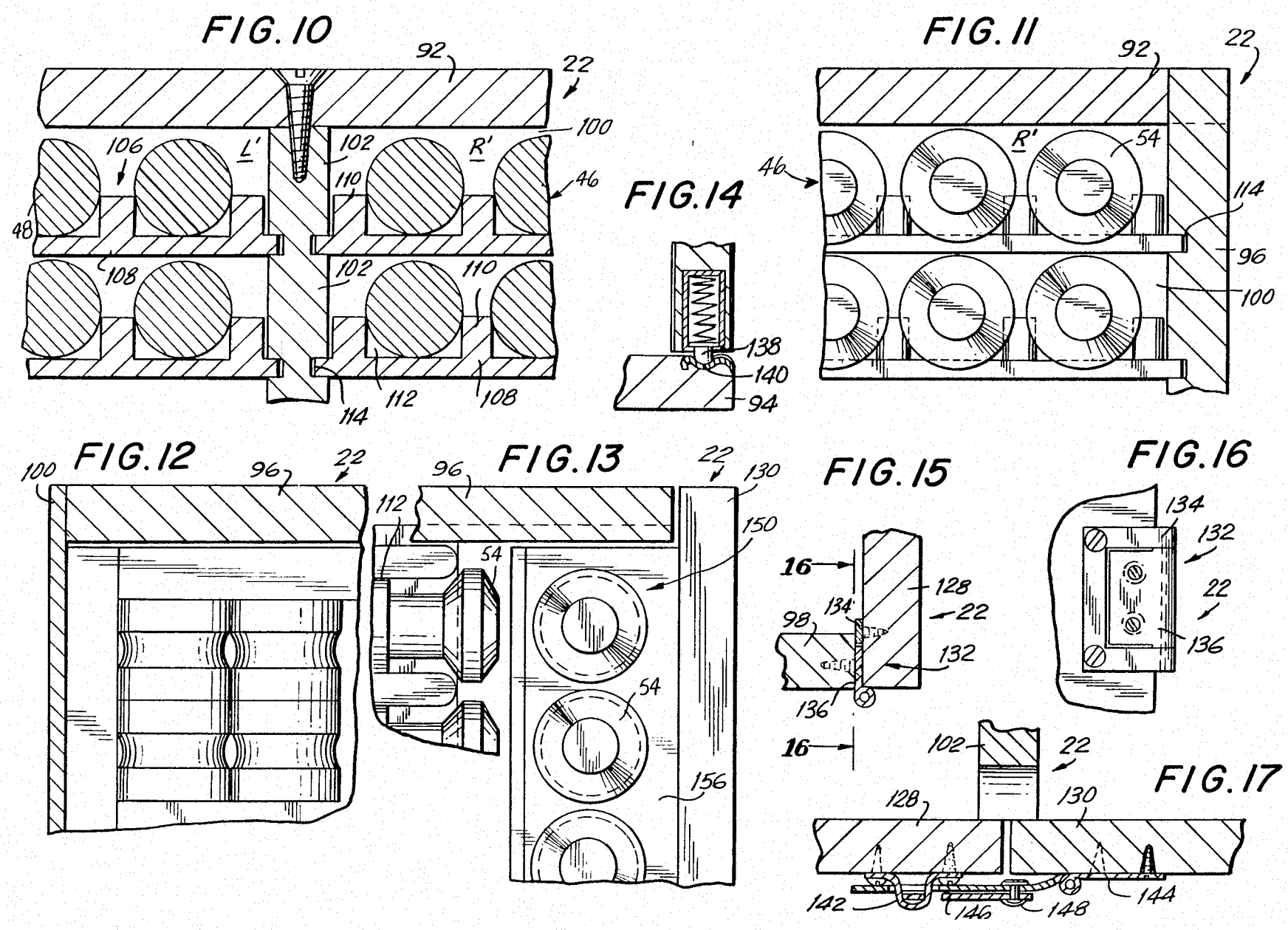
FIG. 10 is an enlarged fragmentary sectional view taken substantially along the line 10—10 of FIG. 8 and illustrating a fragmentary vertical sectional view through a pair of uppermost trays.
FIG. 11 is an enlarged fragmentary sectional view taken substantially along the line 11—11 of FIG. 9 and illustrating a fragmentary vertical sectional view taken somewhat forward of the section of FIG. 10.
FIG. 12 is an enlarged fragmentary sectional view taken substantially along the line 12—12 of FIG. 9 and illustrating the interior of the cabinet immediately above the corner of the tray in which dies are stored.
FIG. 13 is an enlarged fragmentary sectional view taken substantially along the line 13—13 of FIG. 9 and illustrating the heads of some vertically- and some horizontally-stored punches.
FIG. 14 is an enlarged fragmentary sectional view taken substantially along the line 14—14 of FIG. 8 and illustrating the spring-biased bullet-nosed detent which holds a cabinet door closed.
FIG. 15 is an enlarged fragmentary sectional view taken substantially along the line 15—15 of FIG. 8 and illustrating a detail of a flush hinge used to connect a cabinet door to a side panel of the cabinet.
FIG. 16 is a fragmentary view taken substantially along the line 16—16 of FIG. 15 and illustrating a face view of the aforesaid hinge.
FIG. 17 is an enlarged fragmentary sectional view taken substantially along the line 17—17 of FIG. 8 and illustrating a latch used to hold the doors closed.

The front of the cabinet 22 is designed to be protected and covered by a pair of doors 128, 130. A convenient arrangement for attaching the doors to the cabinet constitutes hinges at the side edges of the doors. A typical such hinge is illustrated in FIGS. 15 and 16, being denoted by the reference numeral 132. Concealed flush hinges are employed, two for each door. Each such hinge comprises a pair of leaves 134, 136. The leaf 136 is secured as by screws to the left side wall 98 as shown in FIG. 15. The leaf 134 is secured as by screws to the door 128. Both leaves are received in shallow recesses formed in their respective door edges, and the leaves are interleaved, that is to say, the larger leaf, i.e. the leaf 134, is provided with a cut-out into which the smaller leaf 136 is received when the hinge is in closed condition as illustrated in FIG. 16. The knuckle of the hinge is located on the outside of the cabinet as is clear from FIGS. 8 and 15.

To latch the doors in closed position, each door is supplied with a spring-loaded bullet-nosed detent 138 (FIG. 14) on its bottom edge, adapted to be received in a recess in a metallic catch 140 supplied on the upper surface of the bottom wall 94, in proper position for these elements to engage when the doors are closed.

It also is desirable to provide means to hold the doors closed and, for this purpose, a metal bail 142 is attached to one of the doors, e.g. the door 128, in a position to engage a hasp 144 hinged to the other door (FIG. 17). A hook 146 swings on a rivet 148 fastened to the hasp 144 the rivet being so positioned that when the hasp engages the bail, the hook can be swung to penetrate the opening in the bail.

Up to this point in the description of the cabinet 22, the only storage means that has been described is that for horizontal storage of the punches. These constituted the 100 nests 112 in the trays 106. However, these are insufficient for the purpose mentioned earlier, namely, to supply storage space for a larger number of punches, i.e. 120 punches, so that additional storage space for punches must be included. This is supplied in the cabinet 22 by vertical racks 150 on the vertically hinged doors 128, 130. Such vertical racks are mounted on the inner surface of each of the doors in positions in which they are clear of the right-hand and left-hand side walls 96, 98 when the doors are in closed position (FIG. 13).

Figure 9:
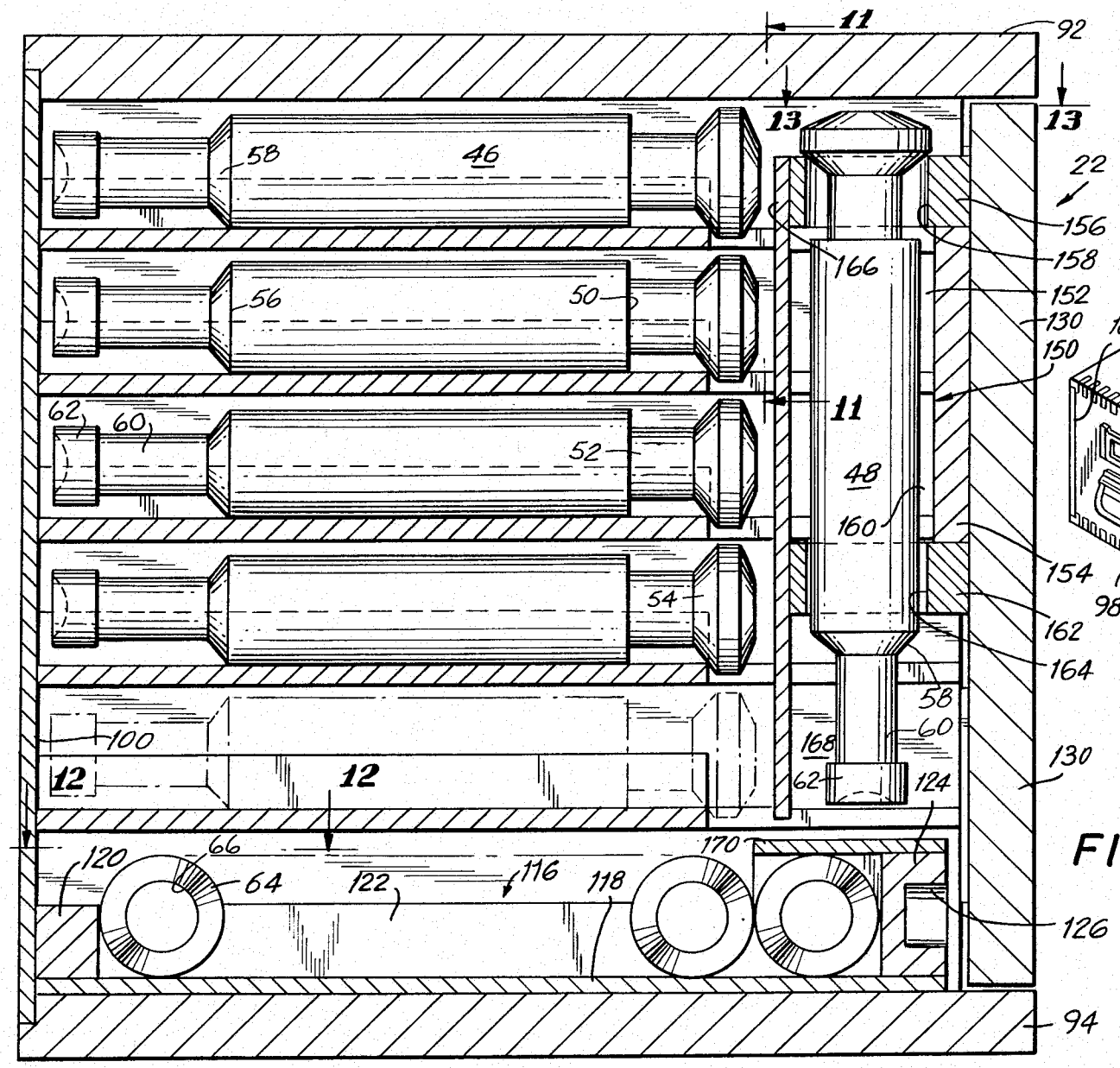
FIG. 9 is an enlarged sectional view taken substantially along the line 9—9 of FIG. 8 and illustrating a staggered vertical section through the cabinet of FIG. 8.

Referring to FIGS. 9 and 13, the vertical racks mounted on the doors 128 and 130, and which contains nests 152 for storing ten punches, includes inside walls 154 which are abutted against the inner surface of the door 128,130 and held thereto in any convenient fashion, for example, by gluing. Immediately above the upper edges of these inner walls there are mounted top closure strips 156. The top closure strips extend from adjacent the side walls 96,98 to the partition 102, and are pierced by a series of circular vertical openings 158 leading to large spaces 160 immediately in front of the inside walls 154. The openings 158 are large enough to easily pass the barrels 48 of punches but not large enough to pass the heads 54 thereof, so that when a punch is introduced into a nest 152 and space 160 through an opening 158, it will enter quite easily until the undersurface of the head strikes the edges of the opening 158 whereupon its downward movement will be checked and the punch will hang from such edges. As soon will be seen, the punch will not dangle with any great freedom of movement because this is abhorent to the principle of controlled storage which is a necessary factor of the instant invention.

Bottom closure strips 162 are secured to the inner surfaces of the door 130, as by gluing, immediately below the inside walls 154 parallel to the top closure strips. These bottom closure strips define the bottoms of the spaces 160 and are formed with a series of openings 164. The openings 164 are in registry with and vertically below the openings 158. These openings 164 are just slightly larger in diameter than the diameter of the barrel of a punch, so that when a punch dangles from the upper edge of an opening 158, the lower edge of the punch, which is approximately aligned with the lower end of the barrel, has only a slight freedom of lateral movement and the punch, accordingly, can rock only very little and cannot gain enough momentum to do itself any damages.

Tempered hardboard panels 166 parallel to the inner surfaces of the doors 128,130 are secured, as by nailing or gluing, to the top and bottom closure strips to isolate the vertical racks 150 on the doors 128,130 from the heads of the punches in the horizontal nests 112. Thereby the horizontally stored punches and the vertically stored punches are effectively maintained separate and are unable to damage one another.

The ends of the punc'. opposite from the head, i.e. the ends constituting the long necks 60 and the tabletting punch heads 62, are located in the spaces 168 below the bottom closure strips, and these, too, are protected by the skirts formed by the lower part of the panels 166. Means soon to be described are included to provide protection for the operative surface of the tabletting punch head, i.e. means in addition to and other than the hardboard panel 166.

The drawer 116 is somewhat different from the drawer 76 in that, as described earlier, the drawer 76 is designed to store dies with the bores in vertical position, whereas the drawer 116 is designed to store dies with the bores in horizontal position. This is largely a matter of choice and it is principally for the purpose of illustration that these two different positions have been shown. The drawer 116 is so dimensioned as to receive 30 punches lying on their sides, i.e. with the bores horizontal. More particularly, the drawer is designed to hold these punches in rows of five and columns of six, so that there will be 30 dies to a drawer, 60 dies in all to match the 120 punches which are held in storage by the cabinet 22. The drawers 116 thus are longer than the drawers 76, and this is intentional inasmuch as the front-to-back distance in the cabinet 22 is greater than the front-to-back distance in the cabinet 20. This causes the fronts of the drawers 116 to extend under the vertical racks 150. Said fronts are covered by tempered hardboard strips 170 nailed or glued to the upper edges of the drawers 116. These strips aid in protecting the operative surfaces of the tabletting punch heads 62 which are a short distance above it.

It thus will be seen that there are provided devices which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters patent:

1. In combination, for use in a tabletting machine in which a series of operations are performed in the compacting of a powder to form tablets:

(A) a stored set of matching dies and punches, there being two punches for each die, the stored set of matching dies and punches being interchangeable with other sets of matching sets of dies and punches for the manufacture of different sizes, shapes and weights of tablets, (i) each die being squat and having a circular bore, (ii) each punch being elongated and including a cylindrical barrel many times longer than a die, each barrel terminating in a neck which carries an enlarged mushroom head, the other end of the barrel having a second neck which is longer than the neck on which the mushroom head is secured, the second neck terminating in a smaller head designed to match with a bore in the die to be received therein in a sliding fit; and (B) a storage cabinet in which the set of matching dies and punches are received, said storage cabinet comprising plural, horizontal storage trays with their fronts in vertical registration, means to slideably support said trays in stacked horizontal positions, each storage tray containing plural elongated, horizontal nests for supporting the barrels of said punches, each nest having a front edge located within the cabinet, the mushroom heads of said punches overhanging said trays and being disposed within said cabinet, said nests having upstanding sides for restricting movements of the punches against lateral shifting of the punches, said cabinet having a front wall, said front wall and the front edges of the nests cooperating with the mushroom heads to restrict axial movement of the punches while preventing contact of the smaller heads of the punches with the wall of the cabinet opposite the front wall of the cabinet, said tray supporting means permitting movement of the trays relative to one another in a manner such as to provide access to individual punches in the trays for withdrawal therefrom for insertion into the tabletting machine or for placement of individual punches withdrawn from the machine into the trays, and a further horizontal tray in the cabinet in which the dies are disposed.

2. A combination as set forth in claim 1, wherein the nests are formed by ribs which are upstanding on the shelves to form the nests between them.

3. A combination as set forth in claim 1, wherein the cabinet includes top and bottom walls and side walls mutually defining a front, wherein the top and bottom walls provide tracks, wherein thin doors have their upper and lower edges sliding in said tracks, and wherein said doors carry handles with slight projections extending rearwardly from their rear surfaces which butt against the insides of the side walls when the doors are closed to act as latches and which will clear such side walls when the doors are bowed.

4. A combination as set forth in claim 1, wherein the storage cabinet further includes vertical nests for reception of some punches, said vertical nest further comprising a strip in the front of the cabinet having openings therein large enough to pass the barrels of the punches, but not large enough to pass the mushroom heads of the punches so that the punches in the vertical rack hang suspended from the mushroom heads parallel to the front wall of the storage cabinet and wherein the front wall further includes a lower strip mounted on the inside of the front wall and provided with opening aligned with openings in the upper strip to pass the barrels of the punches.

5. A combination as set forth in claim 4, wherein the storage cabinet includes vertically hinged front doors and wherein the vertical nests are mounted on the vertically hinged front doors.

6. A combination as set forth in claim 1, wherein the cabinet is $23\frac{1}{2}''$ long and $7\frac{3}{4}''$ high.

7. A combination as set forth in claim 6, wherein the cabinet is $6\frac{1}{8}''$ deep.

8. A combination as set forth in claim 6, wherein the cabinet is $7\frac{3}{4}''$ deep.

* * * * *